United States Patent [19]

Stumpp

[11] 4,048,967

[45] Sept. 20, 1977

[54] SYSTEM FOR DETOXICATING EXHAUST GASES

[75] Inventor: Gerhard Stumpp, Stuttgart, Germany

[73] Assignee: Robert Bosch GmbH, Stuttgart, Germany

[21] Appl. No.: 628,382

[22] Filed: Nov. 3, 1975

Related U.S. Application Data

[62] Division of Ser. No. 366,260, June 4, 1973, Pat. No. 3,954,091.

[30] Foreign Application Priority Data

Aug. 25, 1972 Germany ..... 2241935

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 2,154,417 | 4/1939 | Anderson | 123/119 A |
| 2,543,194 | 2/1951 | Paris, Jr. | 123/119 A |
| 2,722,927 | 11/1955 | Cornelius | 123/119 A |
| 3,237,615 | 3/1966 | Daigh | 123/119 A |
| 3,542,003 | 10/1970 | Sarto | 123/119 A |
| 3,646,923 | 3/1972 | Sarto | 123/119 A |
| 3,730,156 | 5/1973 | Sarto | 123/119 A |
| 3,807,373 | 4/1974 | Chen | 123/119 A |
| 3,820,514 | 6/1974 | Kuehl | 123/119 A |
| 3,954,091 | 5/1976 | Stumpp | 123/119 A |

*Primary Examiner*—Carroll B. Dority, Jr.
*Assistant Examiner*—Sheldon Richter
*Attorney, Agent, or Firm*—Edwin E. Greigg

[57] ABSTRACT

A system for detoxicating the waste gases of an internal combustion engine is described, in which system at least a part of the waste gases is fed, controlled by valve means, into the intake air of the engine, and wherein the said valve controlling waste gas introduction into the intake air is actuated in dependence on the position of the flap of a throttle valve in the air intake duct of the engine.

3 Claims, 3 Drawing Figures

SYSTEM FOR DETOXICATING EXHAUST GASES

This is a Division of application Ser. No. 366,260 filed June 4, 1973, now U.S. Pat. No. 3,954,091.

BACKGROUND OF THE INVENTION

The invention relates to a system for detoxicating exhaust gases in internal combustion engines, whereby at least a part of the exhaust gases is fed, controlled by valve means, into the intake air aspirated by the engine.

Such systems serve the purpose of reducing to a minimum the discharge of toxic nitric oxides from internal combustion engines particularly when the latter are used in densely populated areas. An excessive recycling of exhaust gases causes too large an emission of carbohydrates; insufficient recycling results in an inadequate elimination of nitric oxides from the waste gases. Furthermore, the recycling of exhaust gases during idling of the engine should be interrupted in order to achieve a true running of the engine even during idling. The same is also true for operation of the engine under full load, during which the throttle valve is completely opened and a high power output rate must be attained.

OBJECT AND SUMMARY OF THE INVENTION

It is an object of the invention to provide a system of the type initially described, for detoxicating exhaust gases, which fulfills the above-mentioned requirements and can at the same time be produced cheaply, particularly when manufactured in large numbers.

This object is attained according to the invention in a system of the type described wherein the above-mentioned valve means is actuated in dependence on the position of the flap of a throttle valve in the air intake duct of the engine.

In a preferred embodiment of the invention, a movable valve member of the aforesaid valve means, preferably in the shape of a disc, is directly connected to the shaft of the throttle valve flap and is actuated by rotation of the said flap shaft. In this embodiment, it is of advantage to provide an exhaust gas recycling line the cross-sectional area of which is rendered variable by means of the valve disc which latter extends across the recycling line and is rotatable about its central axis. The rim of the disc is provided with a profiled cam portion which cooperates with an interrupted section of the recycling line. Depending on the design of the cam in the profiled rim portion, it is possible to very exactly proportion the dosage of the exhaust gases which is to be recycled. According to another advantageous feature in a preferred embodiment of the system according to the invention, the valve is controlled by the pressure prevailing in the air intake pipe, in which case the valve, which is closed in the rest position, operates pneumatically; the mouth of the control duct of the valve is arranged upstream of the throttle valve and more particularly upstream of that part of the throttle valve which moves counter to the air flow when air is admitted to the engine, but still within the immediate reach of this part of the throttle valve, whereby the pressure in the suction duct is decreased. Thereby, the valve remains closed when the throttle valve is almost closed, as is the case when the engine is idling, and also when the throttle valve is wide open, as is the case when the engine operates under full load. Thus, when the throttle flap is closed, the orifice which opens in the wall of the air intake pipe through the control conduit leading to the valve is subjected to full air pressure prevailing upstream of the throttle flap, while during the opening movement of the flap, the pressure drop caused by the internal combustion engine acts increasingly on this aforesaid conduit orifice.

The invention will be better understood and further objects and advantages will become apparent from the ensuing detailed specification of preferred but merely exemplary embodiments taken in conjunction with the drawings.

DESCRIPTION AND OPERATION OF THE EMBODIMENTS

In a suction tube 1 only part of which is shown, a throttle valve 2 is pivotally mounted on a spindle 3 which is disposed in radial direction in the tube.

Figure 1:
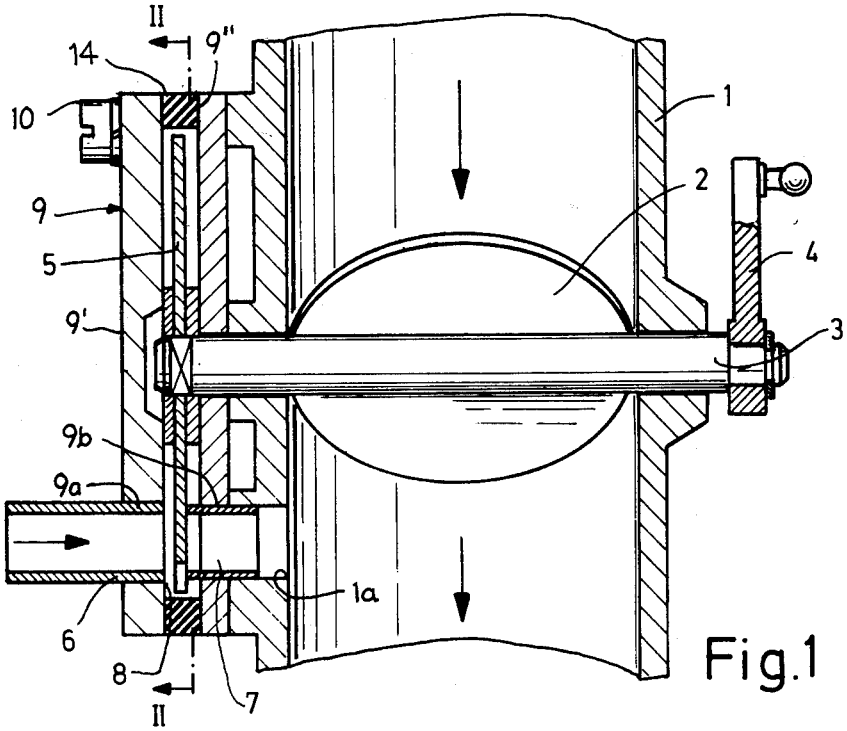
FIG. 1 shows a first embodiment of the system for detoxicating exhaust gases according to the invention.
Figure 2:
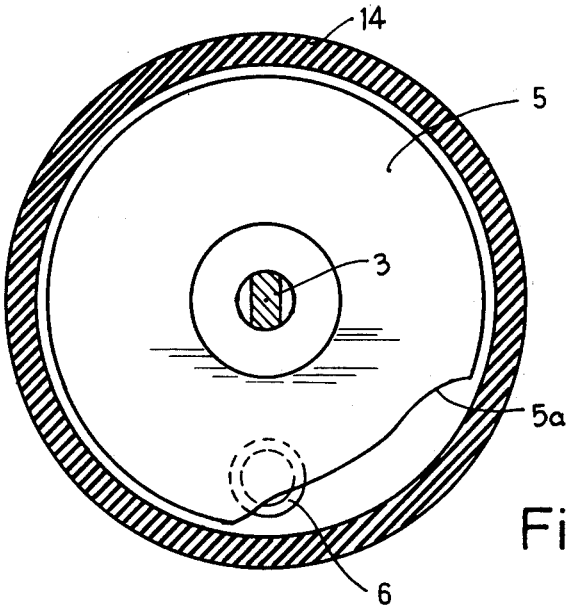
FIG. 2 is a partial sectional view taken along line II—II in FIG. 1.

The spindle 3 together with the throttle valve 2 is coupled by a lever 4 to the accelerator pedal (not shown). A disc 5 is attached to the other end of the spindle 3 and extends in a plane perpendicular to the spindle axis. The rim of the disc is profiled having a cam rim portion 5a as shown in FIG. 2 and controls the mouth of a recycling tube 6, which is a branch line for recycling exhaust gas from the exhaust of the internal combustion engine and which opens out into a chamber 8 which interrupts the recycling line; the latter is continued through a duct 7 and finally opens into tube 1 downstream of the throttle valve 2. The chamber 8 is defined by a housing 9 mounted by studs 10 directly to the tube 1. The housing 9 includes openings **9*a* and 9*b* to which the tube 6 and duct 7 are mounted, respectively. The duct 7 also extends into an opening 1a in the side wall of the tube 1. Preferably, the housing 9 includes parallel plates 9' and 9'' spaced apart by a seal 14**.

Figure 3:
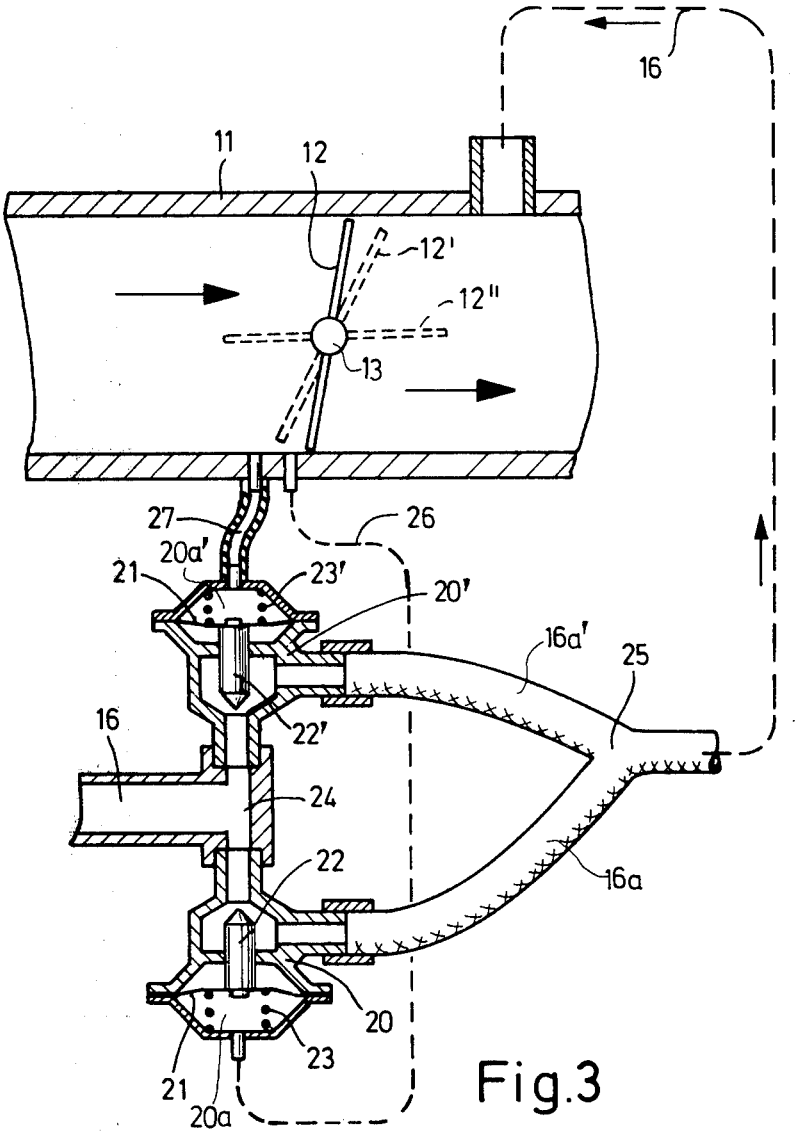
FIG. 3 shows a second embodiment of the system according to the invention.

In the second embodiment shown in FIG. 3, the exhaust gas recycling line 16 also opens into the suction tube 11 downstream of the throttle valve 12. The flow of exhaust gas through recycling line 16 is controlled by valves 20 and 20', which comprise each a diaphragm 21, 21' actuating a displaceable valve member 22, 22' which is fastened thereto. Each diaphragm 21, 21' is biassed by a spring 23, 23' which urges the displaceable valve member 22, 22' into contact with its valve seat 28, 28' in the rest position.

As shown in FIG. 3, the exhaust gas return line 16 divides at 24 into two branches leading to the valves 20 and 20', respectively, downstream of which the branch lines **16*a* and 16*a'* combine again at 25. The interior chambers 20*a* and 20*a'* of valves 20 and 20' which respectively house springs 23 and 23' are connected with the suction pipe 11 by control conduits 26 and 27. The control conduit 26 opens out into the suction pipe 11 at a point which is located upstream of throttle valve 12 when the latter is closed. The more the flap of throttle valve 12 is opened by being turned clockwise (in FIG. 3) about flap shaft 13, the more the reduced air pressure prevailing downstream of the throttle valve 12** acts on this orifice.

It is however to be taken into account that in idling position 12' of the throttle valve flap this influence is negligible.

When the throttle valve flap is in full load position 12", then the spaces in the pipe 11 upstream and downstream of the throttle valve are no longer separated from one another, whereby the same pressure level prevails in both portions of the pipe and, consequently, the throttle valve does not influence the pressure at the orifice of the control conduit 26. The second control conduit 27 opens out into the suction pipe 11 at a point further upstream than the orifice of control conduit 26. Thereby, the influence of the throttle valve 12 on this orifice is correspondingly reduced, i.e., the valve 12 begins to control the orifice of conduit 27 only when opened wider, causing valve 20' to open.

Depending on the position occupied by setting the throttle valve 12, the control pressure acting on the orifices of control 26 and 27, respectively, is correspondingly varied. When throttle valve 12 is closed and the engine is idling, the pressure at these orifices corresponds to the prevailing pressure in the surrounding atmosphere, which means that the valves 20 and 20' remain closed. As the throttle valve 12 is gradually opened the reduced pressure resulting downstream of the throttle valve 12 will have its effect first in the control conduit 26, and only after further turning of throttle valve 12 to a wider position will the resulting reduced pressure have an effect on the flow of recycled exhaust gas through conduit 27, whereby the corresponding valves 20 and 20' will be opened successively in that order to different degrees. In the higher load ranges up to and including full load, the ambient atmospheric pressure and the pressure downstream of the throttle valve will become gradually equalized, so that the valves 20 and 20' will again be gradually closed until, at full load the recycling of exhaust gases is completely interrupted.

What is claimed is:

1. In a system for detoxicating exhaust gases in an internal combustion engine, having air intake pipe means and conduit means for recycling a part of the exhaust gases of said engine into said air intake pipe means, the improvement comprising, in combination, valve means for controlling the flow of said part of the exhaust gases being thus recycled, throttle means comprising a flap and being associated with said air intake pipe means, and means for controlling said valve means in dependence on the adjustment of said throttle flap, wherein i. said means for controlling said valve means are so connected to said air intake pipe means that said valve means are controlled by the pressure prevailing in the adjacent zone of said air intake pipe means;

ii. said flap of said throttle means is turnably disposed in said air intake pipe means whereby during turning of said flap to admit air to the engine a portion of said flap moves against the direction of flow of intake air through said air intake pipe means;

iii. said valve means comprise pneumatically operating valve means being closed in non-actuated position, and a control conduit from said air intake pipe means to said valve means for having the air pressure in the former act on the latter, which conduit opens into said air intake means upstream of the flap of said throttle means and upstream of that portion of said flap which moves against the direction of intake air flow, but still within the immediate vicinity of the latter flap portion, whereby, at almost closed flap during idling of the engine, and also during wide open flap position during full load operation of the engine, said pneumatically operating valve means remain closed; and iv. said pneumatically operating valve means comprise two valves controllable independently of one another and interposed in parallel in said exhaust gas recycling conduit means and two control conduits, one of said control conduits leading from one of said valves to said air intake pipe means and opening in the latter upstream of said throttle means, and the other control conduit leading from the other valve to said air intake pipe means and opening in the latter upstream of the opening of the former control conduit thereinto.

2. The improvement described in claim 1, wherein said pneumatically operating valve means comprise a membrane exposed to the air pressure in said air intake pipe means, and a movable valve member connected thereto and being actuated by said membrane.

3. The improvement described in claim 2, wherein said pneumatically operating valve means comprise a valve housing enclosing said membrane to protect the latter from contact with the exhaust gases flowing through said recycling conduit means.

* * * * *